United States Patent [19]

Klein

[11] Patent Number: 4,924,503

[45] Date of Patent: May 8, 1990

[54] ELECTROACOUSTIC TRANSDUCER

[76] Inventor: Siegfried Klein, 42, rue de la tour d'Auvergne, 75009 Paris, France

[21] Appl. No.: 324,722

[22] Filed: Mar. 17, 1989

[30] Foreign Application Priority Data

Mar. 19, 1988 [DE] Fed. Rep. of Germany ... 8803776[U]

[51] Int. Cl.[5] ..... H04R 15/00

[52] U.S. Cl. ..... 381/190; 381/191; 381/202

[58] Field of Search ..... 381/190, 191, 202

[56] References Cited

FOREIGN PATENT DOCUMENTS 177383 8/1985 European Pat. Off. .

303547 2/1989 European Pat. Off. ..... 381/190

*Primary Examiner*—Jin F. Ng

*Assistant Examiner*—M. N. McGeary, III

*Attorney, Agent, or Firm*—Antonelli, Terry, Stout & Kraus

[57] ABSTRACT

In the case of an electroacoustic transducer with a supporting body carrying coil turns and in particular a vibrating hollow body with a curved surface, such as a magnetostrictive ball, in order to obtain an optimum distribution of the modulation energy, it is proposed that the coil is applied to the supporting body (2) as a flat material corrugated strip (3) at right angles to the running direction.

10 Claims, 1 Drawing Sheet

ELECTROACOUSTIC TRANSDUCER

Figure 1:
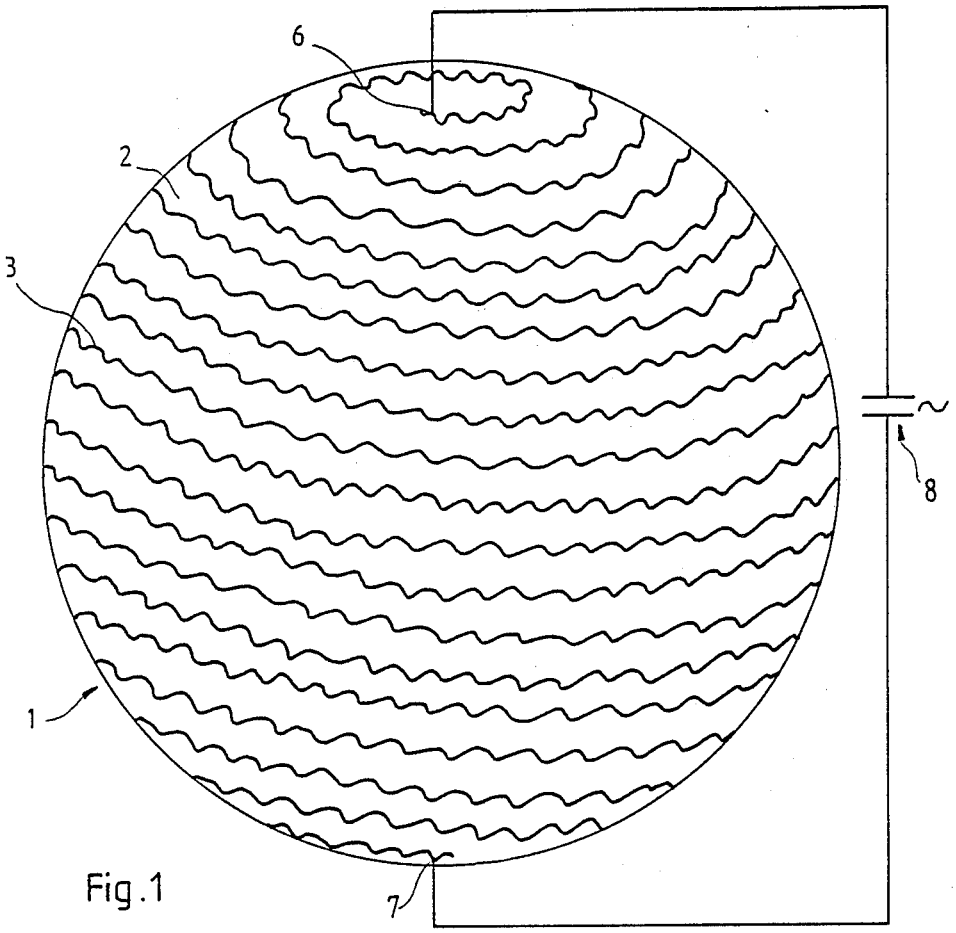

The invention relates to an electroacoustic or acoustoelectric transducer with a supporting body carrying coil turns, particularly a vibrating or oscillating hollow body with a curved surface, such as a magnetostrictive ball or sphere.

Such an acoustic transducer is known from No. EP-A-0 177 383, to which reference should be made. This publication discloses an omnidirectional electroacoustic transducer, i.e. irradiating or emitting in all directions with, in the preferred embodiment, spherical bodies made from magnetostrictive material, which can expand and contract in a magnetic field and therefore in an appropriately modulated field can produce air vibrations through its movement and which can therefore serve as a loudspeaker. According to a preferred embodiment the magnetostrictive body is used as a supporting body for a coil producing the modulated magnetic field and in the form of round copper wire windings closely wound onto the supporting body. However, it has been found that this construction is not of an optimum nature, because the copper wire firmly constricts the magnetostrictive body and therefore influences and damps its vibration behaviour. Other known constructions, in which the magnetostrictive body itself serves as a conductor for the current producing the magnetic field can only be used in the case of small bodies, which can only bring about the desired sound volume (amplitude) at low frequencies.

The problem of the invention is to further develop the known transducer, whilst avoiding the indicated disadvantages in such a way that with a simple application of the coil turns a uniform distribution of the modulation energy is achieved without impairing the vibration behaviour of the magnetostrictive body, whilst in particular obtaining larger transducers which are consequently suitable for low frequencies.

According to the invention the above problem is solved in the case of an electroacoustic transducer of the aforementioned type in that the coil is applied to the supporting body as a corrugated flat material strip at right angles to the running direction. The term strip corrugated in the running direction means that the crests and valleys of the strip extend at right angles to the running direction thereof and alternate therein. The invention particularly leads to an optimum uniform distribution of the modulation energy. The conductive strip can easily vibrate with the supporting body. The corrugated strip only rests on the supporting body with its valleys, whilst it extends freely between corresponding bearing lines. If the magnetostrictive supporting body contracts, then the crests are slightly raised and narrowed, whereas if the body expands the crests become flatter. However, the strip in no way impairs the movement of the magnetostrictive body, because it gives way in a completely flexible manner without exerting any significant restoring forces. This is particularly the case if the strip is made from copper, which has appropriate desired, elastomechanical characteristics, namely is flexibly deformable, but without having strong elastic restoring forces, whilst it is also electrically suitable as a result of a low resistivity.

Although aluminium has a somewhat lower conductivity than copper, its conductivity is still very good. However, it also has a lower weight and a strip made from this material has an even smaller influence on the oscillation of the magnetostrictive ball than a copper strip.

The strip can easily be applied. It has been found that particularly in the case of large transducers with diameters of a few decimetres the flat material is suitable, inter alia because it does not twist. As a result of its transverse corrugation, the corrugated flat strip adapts in an optimum manner to the doubly curved supporting body, such as in particular a ball, but which can also be an ellipsoid of revolution with a curved generatrix. With its corrugated shape it can easily be applied to larger bodies with curved surfaces, such as in particular a ball, because it can then adapt to the curved shape as a result of the transverse corrugations. It represents the only practicable solution with such larger vibrating bodies with a size of several decimetres. If corrugated conductive strips are merely wound or optionally fixed in a random manner on the supporting body, particularly a ball, then according to a preferred embodiment the strip is adhered to the supporting body. The corrugated strip is only adhered to the supporting body in the vicinity of its valleys, whereas the crests project freely from the supporting body, so that they can readily undergo the aforementioned deformation. Various adhesion or bonding possibilities exist. In a preferred embodiment the back of the corrugated strip is provided with an adhesive coating, e.g. in the form of a double-sided adhesive tape, i.e. a tape coated with adhesive on both sides. However, in place of this the supporting body can provided with an adhesive, optionally in the form of a double-sided adhesive tape. In addition, the corrugated conductive strip and/or the supporting body could be provided with a thermoplastic layer. The corrugated conductive strip is then applied under heating to the supporting body, so that after cooling and therefore solidification the thermoplastic layer is firmly joined to the supporting body. The width of the corrugated conductive strip can vary considerably and for a given material thickness is dependent on the winding length, the desired impedance and the desired number of turns. In a preferred manner, the width of the corrugated strip is between 0.5 and 2.0 percent of the supporting body diameter, typical widths being between 5 and 10 mm.

The spacing of the turns, without reciprocal contact, should be as small as possible in order to avoid or substantially reduce electromagnetic coupling losses. As a function of the ball size, spacings of approximately 1 mm and less can be achieved.

As a result of the invention both the inductive, magnetic coupling between the ball and said modulation strip is at a maximum and can be uniformly distributed over the entire surface. Moreover, the inductive coupling losses at the lower frequencies are substantially avoided and the impedance can be brought to a desired value of e.g. 4 Ohm. It would not be possible to achieve these aims by a round wire, which would either lead to an excessively high impedance or, in the case of a thick construction due to said thickness, a poor coupling and losses. The strip is applied to the magnetostrictive ball by means of an insulating layer (adhesive, etc) and vibrates therewith, without in any way impairing its vibrating behaviour. If a higher coil strip resistance is desired, it is also possible to use a different conductive material to copper, e.g. in particular nickel.

Further advantages and features of the invention can be gathered from the claims and the following description of a non-limitative embodiment of an electroacoustic transducer and with reference to the attached drawings, wherein show:

FIG. 1 a side view of the complete electroacoustic transducer, with diagrammatic representation of the conductor guide.

Figure 2:
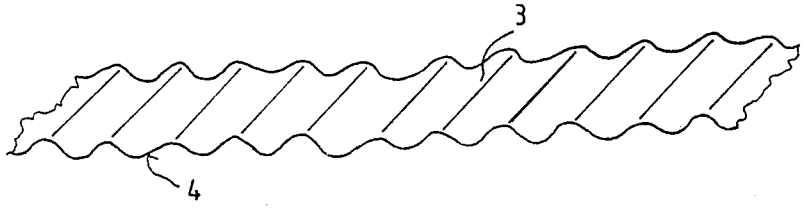

FIG. 2 a larger scale view of the corrugated conductor used in the inventive transducer.

The inventive acoustic transducer 1 in the represented embodiment has a spherical supporting body 2, which is made from a magnetostrictive material, such as a nickel—cobalt alloy with a high nickel percentage, or a layer of such a material on an insulating elastic support. A conductor in the form of a transversely corrugated, conductive strip 3 is applied in electrically insulated manner to the supporting body. FIG. 1 diagrammatically shows the guidance and corrugation of the strip shown in detailed form in FIG. 2. The insulation can be formed by a fastening layer 4 applied to the back of the corrugated, conductive strip 3. Layer 4 can be an adhesive layer, e.g. in the form of a two-sided adhesive tape. However, it can also be thermoplastic layer by means of which the corrugated strip 3 is fixed under high temperature to the supporting body 2.

Alternatively the supporting body 2 can be directly provided with an insulating layer, also in the form of a thermoplastic or adhesive layer, optionally in the form of a wound-on adhesive tape adhering on both sides. A corrugated conductive strip 3 can then be applied and fixed without having itself any rear fixing layer. Conductive strip 3 is preferably made from copper. Conductive strip 3 is wound onto the supporting body 2 in the manner shown in FIG. 1. As a result of its corrugated construction it can be easily adapted to the contour of the supporting body 2, which can be of a random nature. In addition, the corrugated strip 3 is resilient, so that it adapts in flexible manner during the vibrations of the supporting body 2 consisting of radius increases and/or decreases, so that no tensions occur and in particular the vibrating behaviour of body 2 is in no way impaired by the coil formed by conductor 3. When the inventive acoustic transducer is used as a loudspeaker the ends 6,7 of the corrugated strip 3 are connected to a voltage supply 8 supplying a suitably modulated voltage, optionally across impedance transformers and whilst providing other suitable electronic components, such as are e.g. described in No. EP-A-0 177 383.

The width of the corrugated strip is such that it can be applied with an adequate number of electrically separate i.e. spaced turns to the body 2. The strip width is therefore preferably 0.5 to 2% of the diameter of a body of revolution, preferably a ball, e.g. in the case of a supporting body for a loudspeaker covering the standard frequency range from low to high notes and with a supporting body diameter of a few decimetres, it is in the range 5 to 10 mm.

I claim:

1. An electroacoustic transducer comprising a vibrating hollow body (2) with a curved surface carrying coil turns, said vibrating hollow body comprising a magnetostrictive ball, characterized in that the coil is applied to said hollow body as a corrugated strip with corrugations at right angles to the running direction.

2. Transducer according to claim 1, characterized in that the strip (3) is bonded to the supporting body (2).

3. Transducer according to claim 2, characterized in that the corrugated strip (3) has an adhesive layer (4) on it's back.

4. Transducer according to claim 2, characterized in that the supporting body (2) is provided with adhesive.

5. Transducer according to claim 4, characterized in that a double-sided adhesive tape is provided for bonding the corrugated strip.

6. Transducer according to claims 1 or 2, characterized in that the conductive layer of the corrugated strip (3) is made from copper.

7. Transducer according to one of the claims 1 or 2, characterized in that the conductive layer of the corrugated strip (3) is made from nickel.

8. Transducer according to one of the claims 1 or 2, characterized in that the conductive layer of the corrugated strip (3) is made from aluminium.

9. Transducer according to one of the claims 1 or 2, characterized in that the corrugated strip (3) has a width of 5 to 10 mm.

10. Transducer according to claims 1 or 2, characterized in that the width of the corrugated strip (3) is between 0.5 and 2.0% of the diameter of the supporting body (2).

* * * * *